US008315418B2

(12) United States Patent
Watanabe

(10) Patent No.: US 8,315,418 B2
(45) Date of Patent: Nov. 20, 2012

(54) SOUND RECEIVER

(75) Inventor: Junichi Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 932 days.

(21) Appl. No.: 11/826,350

(22) Filed: Jul. 13, 2007

(65) Prior Publication Data

US 2008/0019551 A1 Jan. 24, 2008

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/02*** | (2006.01) |
| ***H04R 5/00*** | (2006.01) |

(52) U.S. Cl. ..... 381/358; 381/26; 381/91; 381/357

(58) Field of Classification Search ..... 381/91, 381/122, 337, 352–354, 160, 356, 357, 358, 381/369, 170, 126, 360, 26; 181/198; 379/388.02
See application file for complete search history.

(56) References Cited

U.S. PATENT DOCUMENTS

| | | | | |
|---|---|---|---|---|
| 2,797,766 | A * | 7/1957 | Sullivan | 181/151 |
| 4,206,324 | A * | 6/1980 | Horikawa et al. | 381/356 |
| 5,282,245 | A * | 1/1994 | Anderson | 379/433.03 |
| 5,526,430 | A | 6/1996 | Ono et al. | |
| 5,848,172 | A * | 12/1998 | Allen et al. | 381/358 |
| 6,237,302 | B1 * | 5/2001 | Fricke | 52/404.1 |

FOREIGN PATENT DOCUMENTS

| | | |
|---|---|---|
| EP | 1 494 500 A2 | 1/2005 |
| EP | 1 494 500 A3 | 5/2009 |
| GB | 2 234 137 A | 1/1991 |
| JP | 59-101585 | 7/1984 |
| JP | 3-131199 | 6/1991 |
| JP | 03-86693 | 9/1991 |
| JP | 04-39799 | 4/1992 |
| JP | 04-217199 | 8/1992 |
| JP | 6-284494 | 10/1994 |
| JP | 09-065478 | 3/1997 |
| JP | 09-238394 | 9/1997 |
| JP | 2000-214862 | 8/2000 |
| WO | WO 99/46956 | 9/1999 |

OTHER PUBLICATIONS

Chinese Office Action issued Jun. 13, 2010 in corresponding Chinese Patent Application 200580046498.4.
International Preliminary Report on Patentability issued in corresponding International Patent Application No. PCT/JP2005/000316, mailed on Jul. 26, 2007.
Japanese Patent Office Notice of Rejection mailed Jan. 18, 2011 for corresponding Japanese Patent Application No. 2006-552802.
Communication issued from the European Patent Office on Apr. 8, 2011 in the corresponding European patent application.
Office Action mailed from the Japanese Patent Office on Apr. 19, 2011 in the corresponding Japanese patent application.

* cited by examiner

*Primary Examiner* — Jesse Elbin
(74) *Attorney, Agent, or Firm* — Staas & Halsey LLP

(57) ABSTRACT

A sound receiver includes a casing having multiple cavities which house multiple microphones and through which sound waves are received. A first sound wave is directly received by microphones. A second sound wave is reflected by an inner wall of the cavities and changes in phase corresponding to the material of the inner wall. The material of the inner wall differs for each cavity, thereby effecting a different change in phase of the second sound wave at each of the inner walls.

13 Claims, 13 Drawing Sheets

SOUND RECEIVER

BACKGROUND OF THE INVENTION

1. Field of the Invention

The present invention relates to a sound receiver having a microphone array.

2. Description of the Related Art

Conventionally, a microphone device having directivity toward a specific speaker direction has been proposed (for example, refer to Japanese Patent Laid-Open Publication No. H9-238394) as a sound input device. This microphone device is a directional microphone in which multiple microphones are arranged on a plane, and outputs of respective microphones are added through a delay circuit, respectively, to obtain an output. A silence detection function acquires a ratio between a cross-correlation function of a predetermined range of time difference between output signals of the respective microphones and a cross-correlation function of a time difference between signals corresponding to set sound source positions, and makes voice and silence determination by detecting that there is a sound source at the set position when this ratio satisfies a predetermined threshold.

However, when the microphone device described above is set in a relatively small space such as a room, the microphone device is often set on a wall of the room or on a table. It is common knowledge that if the microphone device is thus set on a wall or a table, sound clarity is negatively affected by waves reflected from the wall or the table, and when the sound is recognized by a sound recognition system, there has been a problem of deterioration in recognition rate.

Moreover, although a boundary microphone device is engineered so as to receive only a sound wave directly from a speaker without receiving waves reflected from the wall or the like, when multiple boundary microphones are used to act as a microphone array device, there has been a problem in that the directivity is not sufficiently exerted due to individual variations originated in the complicated structure of the boundary microphone. Furthermore, when the microphone array device is mounted on a vehicle, since the space of the vehicle interior is small, the effect of the reflected waves is significant, and there has been a problem in that the directivity is not sufficiently exerted.

SUMMARY OF THE INVENTION

It is an object of the present invention to at least solve the above problems in the conventional technologies.

A sound receiver according to one aspect of the present invention includes a plurality of microphones; and a casing that has a plurality of cavities in which the microphones are housed, respectively, and through which a sound wave from a specific direction enters.

A sound receiver according to another aspect of the present invention includes a plurality of microphones; and a casing that has a cavity in which the microphones are housed and through which a sound wave from a specific direction enters.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Referring to the accompanying drawings, exemplary embodiments according to the present invention are explained in detail below.

Figure 1:
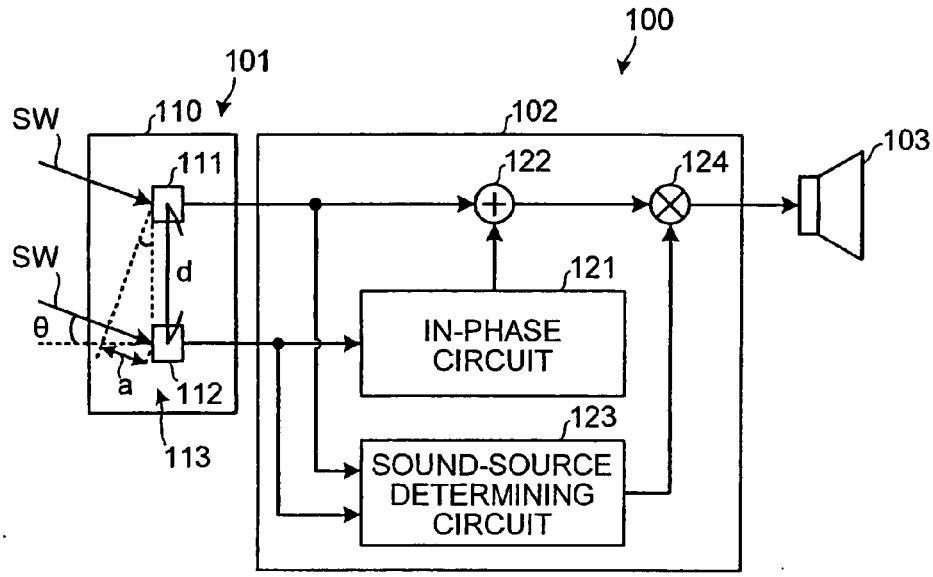
FIG. 1 is a block diagram of a sound processing device that includes a sound receiver according to a first embodiment of the present invention.

FIG. 1 is a block diagram of the sound processing device that includes the sound receiver according to the first embodiment of the present invention. As shown in FIG. 1, a sound processing device 100 includes a sound receiver 101, a signal processing unit 102, and a speaker 103.

The sound receiver 101 is constituted of a casing 110 and a microphone array 113 that includes multiple (two in the example shown in FIG. 2 for simplification) microphones 111 and 112. The microphones 111 and 112 are arranged maintaining a predetermined distance d. The microphone array 113 receives a sound wave SW coming from an external source at a predetermined phase difference. Specifically, there is a time difference $\tau$ ($\tau$=a/c, where c is the speed of sound) that is shifted in time by an amount corresponding to a distance a ($a=d\cdot\sin\theta$).

The signal processing unit 102 estimates sound from a target sound source based on an output signal from the microphone array 113. Specifically, for example, the signal processing unit 102 includes, as a basic configuration, an in-phase circuit 121, an adder circuit 122, a sound-source determining circuit 123, and a multiplier circuit 124. The in-phase circuit 121 makes an output signal from the microphone 112 in phase with an output signal from the microphone 111. The adder circuit 122 adds the output signal from the microphone 111 and an output signal from the in-phase circuit 121.

The sound-source determining unit 123 determines a sound source based on the output signal from the microphone array 113, and outputs a determination result of 1 bit (when "1", a target sound source; when "0", a non-target sound source). The multiplier circuit 124 multiplies an output signal from the adder circuit 122 and a determination result from the sound-source determining unit 123. Moreover, the speaker 103 outputs a sound signal that is estimated by the signal processing unit 102, in other words, sound corresponding to an output signal from the multiplier circuit 124.

Figure 2:
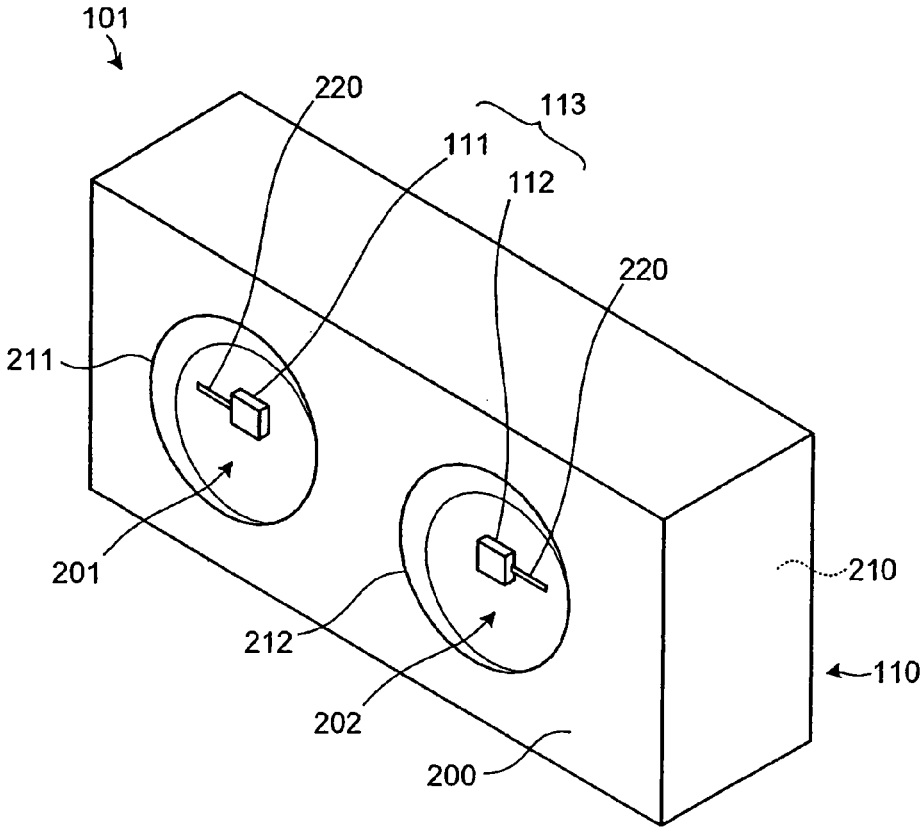
FIG. 2 is a perspective view illustrating an external appearance of the sound receiver shown in FIG. 1.

FIG. 2 is a perspective view illustrating an external appearance of a sound receiver 101 shown in FIG. 1. As shown in FIG. 2, the casing 110 of the sound receiver 101 is, for example, in a rectangular parallelepiped.

Furthermore, the casing 110 is formed with a sound absorbing material selected from among, for example, acrylic resin, silicon rubber, urethane, and aluminum. On a front surface 200 of the casing 110, multiple (two in the example shown in FIG. 2) cavities 201 and 202 are formed in the quantity corresponding to the quantity (two in the example shown in FIG. 2) of the microphones 111 and 112 that constitute the microphone array 113. The cavities 201 and 202 are formed in a line along a longitudinal direction of the casing 101.

Furthermore, the cavities 201 and 202 each have an opening 211 and 212 on the front surface 200 and are otherwise enclosed, i.e., the cavities 201 and 202 do not open through to a rear surface 210. Moreover, the microphones 111 and 112 are arranged at substantially the center of the cavities 201 and 202, respectively, and are supported by supporting members 220 in a fixed manner. The positions, at which the microphones 111 and 112 are arranged, inside the cavities 201 and 202, can be any position that can be viewed through the openings 211 and 212.

Figure 3:
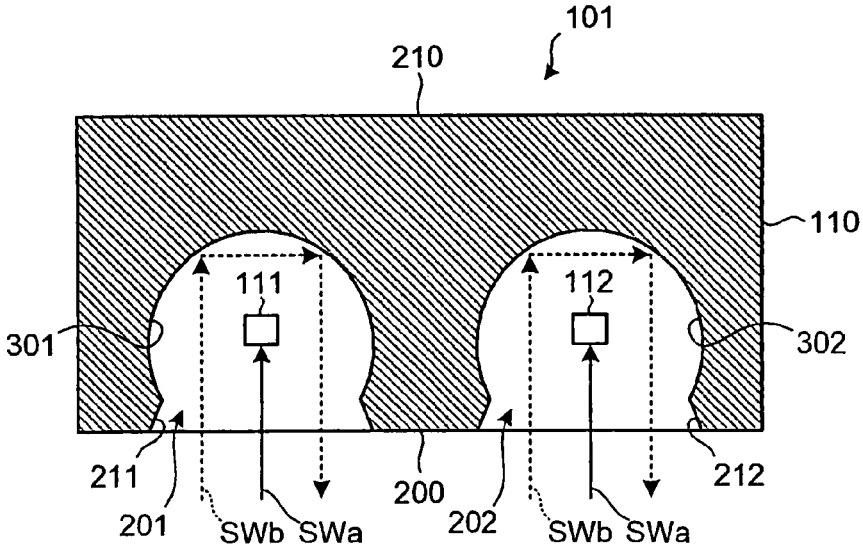
FIG. 3 is a cross-section of the sound receiver according to a first example.

FIG. 3 is a cross-section of the sound receiver according to the first example. The cross-section shown in FIG. 3 is an example of a cross-section of the sound receiver shown in FIG. 2. Like reference characters are given to like components with the components shown in FIG. 2 and the explanation thereof is omitted.

As shown in FIG. 3, the cavities 201 and 202 are formed in a substantially spherical shape, and sound waves are input through the openings 211 and 212 that are formed on the front surface 200 of the casing 110. The shape of the cavities 201 and 202 are not limited to a spherical shape, and can be a three-dimensional shape having random curved sides or a polyhedron. A sound wave from an external source is input only through the openings 211 and 212, and a sound wave from directions other than this direction is shielded by the casing 110 formed with the sound absorbing material, and therefore, is not input, enabling improvement of the directivity of the microphone array 113.

With such a configuration, a sound wave SWa that directly reaches the microphones 111 and 112 is directly received by the microphones 111 and 112 at the predetermined phase difference. On the other hand, a sound wave SWb that reaches inner peripheral walls 301 and 302 of the cavities 201 and 202 passes through the inner peripheral walls 301 and 302 to be absorbed by the inner peripheral walls 301 and 302, or is reflected by the inner peripheral walls 301 and 302 to be output from the cavities 201 and 202. Thus, reception of the sound wave SWb can be suppressed.

As described, according to the sound receiver 101 of the first example, only a sound wave coming from a predetermined direction is received and reception of a sound wave coming from directions other than the predetermined direction is prevented, thereby achieving an effect that a target sound wave can be accurately detected, and that a sound receiver having high directivity is implemented.

Figure 4:
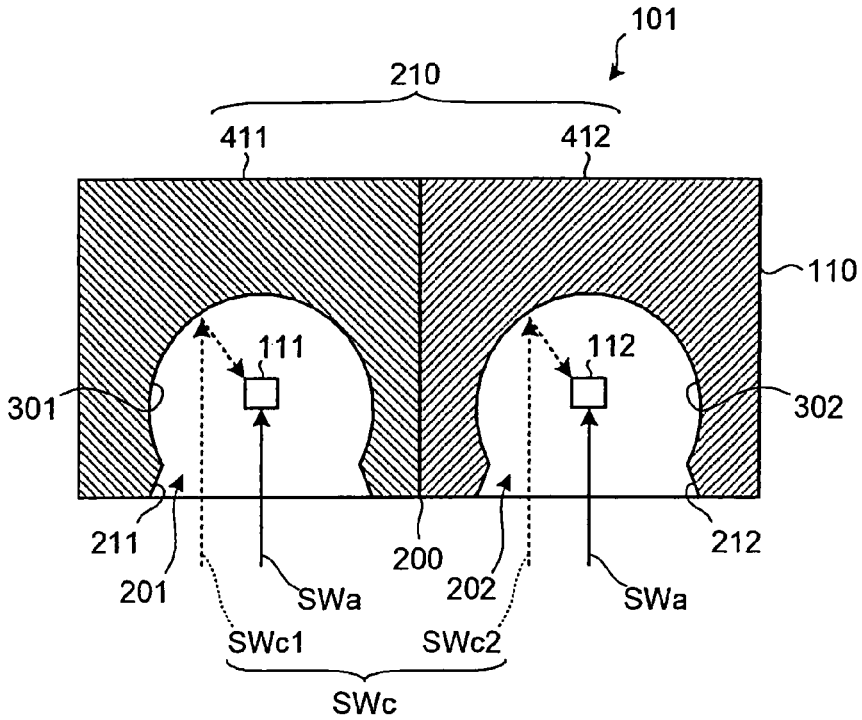
FIG. 4 is a cross-section of the sound receiver according to a second example.

The sound receiver according to the second example is an example in which an inner peripheral wall of each cavity is formed with a different material. FIG. 4 is a cross-section of the sound receiver according to the second example. The cross-section shown in FIG. 4 is an example of the cross section of the sound receiver 101 shown in FIG. 2. Like reference characters are given to like components with the components shown in FIG. 2 and FIG. 3, and the explanation thereof is omitted.

As shown in FIG. 4, the casing 110 is constituted of multiple (two in the example shown in FIG. 4) cells 411 and 412 that are formed for each of the microphones 111 and 112 with sound absorbing materials having different hardness. The cavities 201 and 202 are formed for the cells 411 and 412, respectively, and the microphones 111 and 112 are housed in the cavities 201 and 202, respectively. The material of the cells 411 and 412 is selected from among acrylic resin, silicon rubber, urethane, and aluminum described above. Specifically, for example, the cell 411 can be formed with acrylic resin, and the other cell 412 can be formed with silicon rubber.

In such a configuration, the sound wave SWa that directly reaches the microphones 111 and 112 is directly received by the microphones 111 and 112 at the predetermined phase difference as shown in FIG. 1. On the other hand, a sound wave SWc (SWc1, SWc2) that reaches the inner peripheral walls 301 and 302 of the cavities 201 and 202 are reflected by the inner peripheral walls 301 and 302 of the cavities 201 and 202. At this time, the sound wave SWc1 that is reflected by the inner peripheral wall 301 of the cavity 201 in the cell 411 changes in phase corresponding to the material of the cell 411.

Moreover, the sound wave SWc2 that is reflected by the inner peripheral wall 302 of the cavity 202 in the other cell 412 changes in phase corresponding to the material of the other cell 412. Since the hardness of the materials of the cell 411 and the other cell 412 is different, the phase change of the sound waves SWc1 and SWc2 also differ from each other. Therefore, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the second example, an effect similar to that of the first example can be achieved. Moreover, there are effects that a target sound, that is, sound of the sound wave SWa, can be accurately detected by disarranging the phase difference of the sound wave SWc from an undesirable direction with a simple configuration, and that a sound receiver having high directivity can be implemented.

Figure 5:
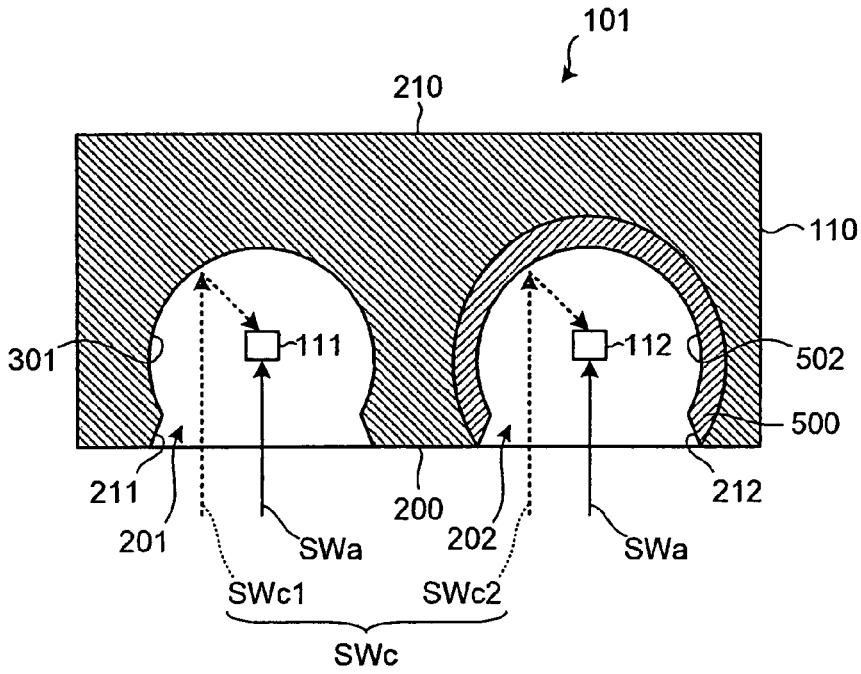
FIG. 5 is a cross-section of the sound receiver according to a third example.

The sound receiver according to the third example is an example in which materials of a casing and a sound absorbing member that form the inner peripheral walls of respective cavities are different. FIG. 5 is a cross-section of the sound receiver according to the third example. The cross-section shown in FIG. 5 is an example of the cross-section of the sound receiver 101 shown in FIG. 2. Like reference characters are given to like components with the components shown in FIG. 2 to FIG. 4, and the explanation thereof is omitted.

In the example shown in FIG. 5, an inner peripheral wall 502 of the cavity 202 is formed with a porous sound absorbing member 500 that is different in hardness from the casing 110. Materials of the casing 110 and the sound absorbing member 500 that forms the inner peripheral wall 502 are selected from among, for example, acrylic resin, silicon rubber, urethane, and aluminum described above. Specifically, for example, when the casing 110 is formed with acrylic resin, the sound absorbing member 500 that forms the inner peripheral wall 502 is formed with a material other than acrylic resin, for example, with silicon rubber.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 301 of the cavity 201 is reflected by the inner peripheral wall 301 of the cavity 201. At this time, the sound wave SWc1 that is reflected by the inner peripheral wall 301 of the cavity 201 changes in phase corresponding to the material of the casing 110.

Meanwhile, the sound wave SWc2 that is reflected by the inner peripheral wall 502 of the other cavity 202 changes in phase corresponding to the material of the sound absorbing member 500 that forms the other inner peripheral wall 502. Since the hardness of the materials of the casing 110 that forms the inner peripheral wall 301 of the cavity 201 and the material of the sound absorbing member 500 that forms the inner peripheral wall 502 of the other cavity 202 is different, the phase change of the sound waves SWc1 and SWc2 also differ from each other. Therefore, the sound wave SWc is received by the microphones 111 and 112 at a phase difference that is different from the phase difference of the sound wave SWa, and is determined as noise by the sound-source determining circuit 123 shown in FIG. 1.

Figure 6:
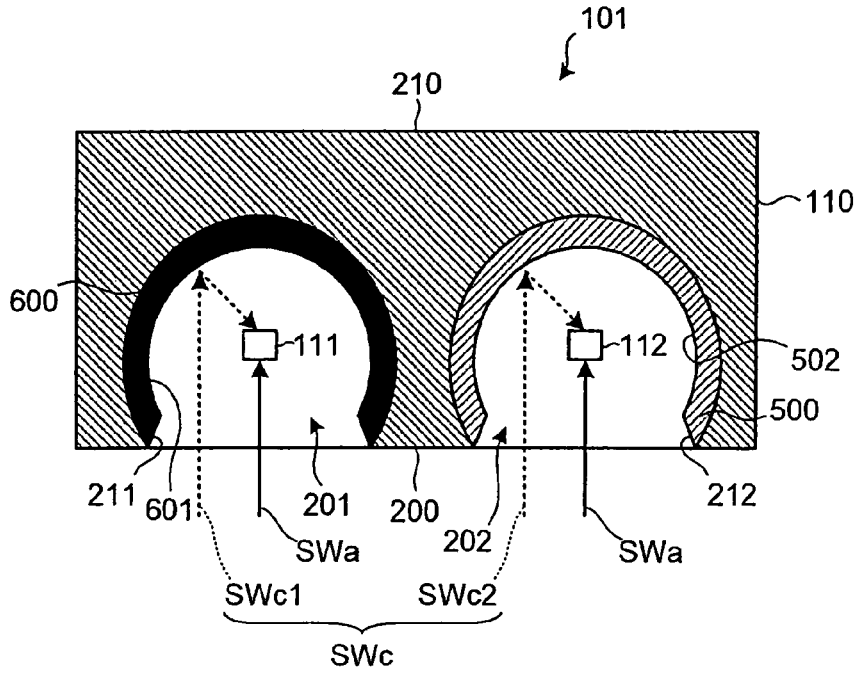
FIG. 6 is a cross-section of another example of the sound receiver according to the third example.

FIG. 6 is a cross-section of another example of the sound receiver 101 according to the third example. In the example shown in FIG. 6, inner peripheral walls 601 and 502 of the cavities 201 and 202 are formed with sound absorbing members 600 and 500 that are different from each other. A material of the sound absorbing member 600 is also selected from among acrylic resin, silicon rubber, urethane, and aluminum described above, similarly to the sound absorbing member 500. Specifically, for example, when the sound absorbing member 600 that forms the inner peripheral wall 601 is formed with acrylic resin, the sound absorbing member 500 that forms the inner peripheral wall 502 is formed with a material other than acrylic resin, for example, with silicon rubber.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 601 of the cavity 201 is reflected by the inner peripheral wall 301 of the cavity 201. At this time, the sound wave SWc1 that is reflected by the inner peripheral wall 601 of the cavity 201 changes in phase corresponding to the material of the casing 110.

Meanwhile, the sound wave SWc2 that is reflected by the inner peripheral wall 502 changes in phase corresponding to the material of the sound absorbing member 500 that forms the other inner peripheral wall 502. Since the hardness of the materials of the sound absorbing member 600 that forms the inner peripheral wall 601 of the cavity 201 and the material of the sound absorbing member 500 that forms the inner peripheral wall 502 of the other cavity 202 is different, the phase change of the sound waves SWc1 and SWc2 also differ from each other. Therefore, the sound wave SWc is received by the microphones 111 and 112 at a phase difference that is different from the phase difference of the sound wave SWa, and is determined as noise by the sound-source determining circuit 123 shown in FIG. 1.

Figure 7:
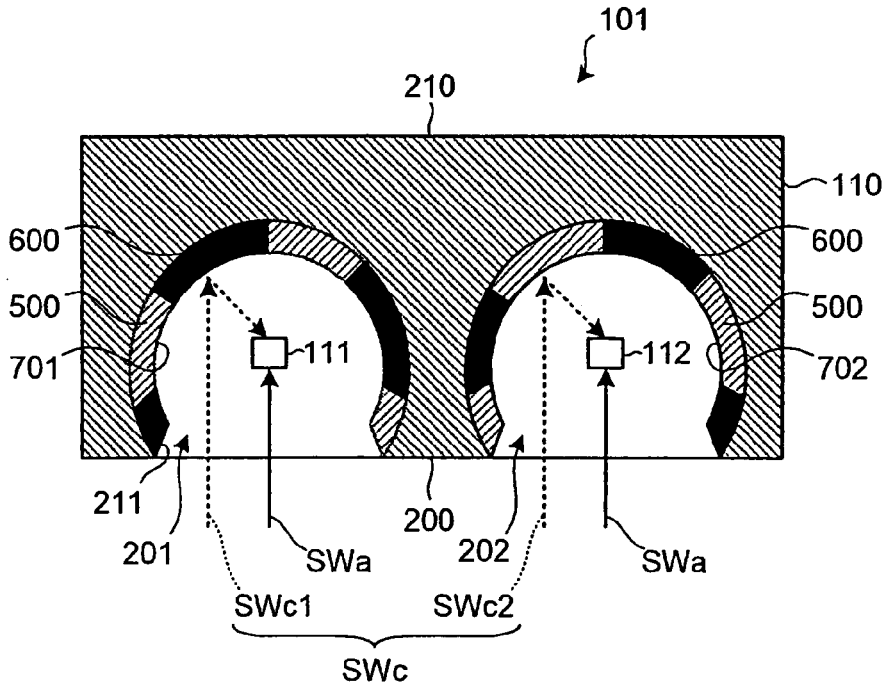
FIG. 7 is a cross-section of another example of the sound receiver according to the third example.

FIG. 7 is a cross-section of another example of the sound receiver 101 according to the third example. In the example shown in FIG. 7, inner peripheral wall 701 of the cavity 201 is formed with sound absorbing members 500 and 600 that are different from each other. Moreover, an inner peripheral wall 702 of the other cavity 202 is also constituted by multiple (two in the example shown in the figure) the sound absorbing members 500 and 600.

Arrangement of the sound absorbing members 500 and 600 is different in each of the cavities 201 and 202, and when the same sound wave reaches the cavities 201 and 202, the sound wave is reflected by the surface of the sound absorbing members 500 (600), which are different from each other. Thus, phases of the sound waves SWc1 and SWc2 that are reflected by the inner peripheral walls 701 and 702 can be randomly changed. Therefore, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the third example, an effect similar to that of the first example can be achieved. Moreover, there are effects that a target sound, that is, sound of the sound wave SWa, can be accurately detected by disarranging the phase difference of the sound wave SWc from an undesirable direction with a simple configuration, and that a sound receiver having high directivity can be implemented.

Figure 8:
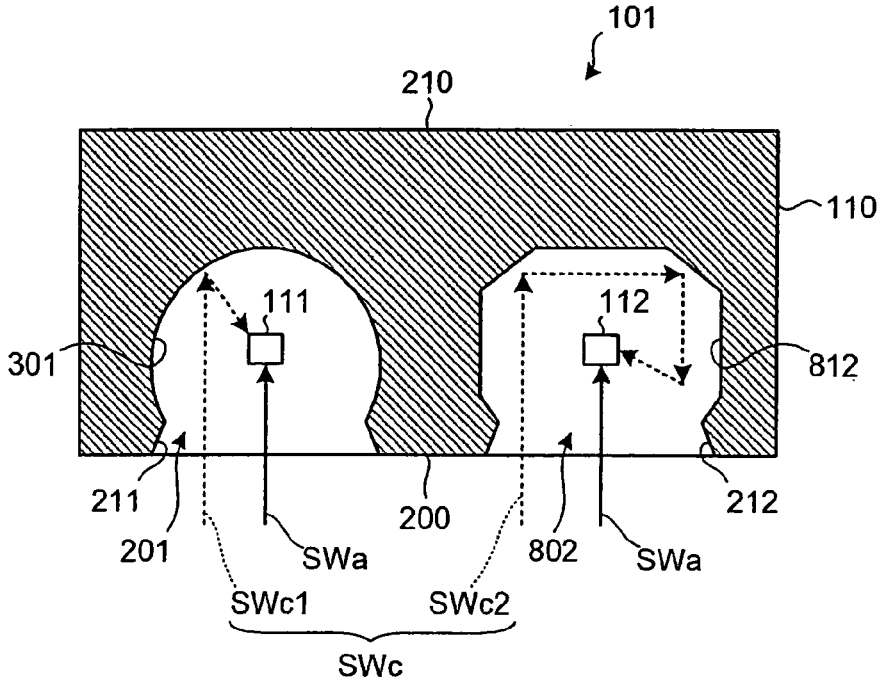
FIG. 8 is a cross-section of the sound receiver according to a fourth example.

The sound receiver according to the fourth example is an example in which the shapes of cavities differ from each other. FIG. 8 is a cross-section of the sound receiver according to the fourth example. The cross-section shown in FIG. 8 is an example of the cross-section of the sound receiver 101 shown in FIG. 2. Like reference characters are given to like components with the components shown in FIG. 2, and the explanation thereof is omitted.

In the example shown in FIG. 8, cavities 201 and 802 are formed in different shapes from each other. In the example shown in FIG. 8, the cavity 201 is formed to have a substantially circular cross-section, in other words, in a substantially spherical shape, and the other cavity 802 is formed to have a substantially polygonal cross-section, in other words, in a substantially polyhedron.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 301 of the cavity 201 is reflected by the inner peripheral wall 301 of the cavity 201 to be received by the microphone 111.

Meanwhile, the sound wave SWc2 that reaches the inner peripheral wall 812 of the other cavity 802 is reflected by the inner peripheral wall 812 of the other cavity 802 to be received by the microphone 112. Since the cavities 201 and 802 in the casing 110 are formed in different shapes from each other, the reflection path length of the sound wave SWc1 and the reflection path length of the sound wave SWc2 are different. Therefore, the sound wave SWc is received by the microphones 111 and 112 at a phase difference that is different from the phase difference of the sound wave SWa, and is determined as noise by the sound-source determining circuit 123 shown in FIG. 1.

As described, with the sound receiver 101 according to the fourth example, an effect similar to that of the first example can be achieved. Moreover, by merely forming the cavities in different shapes, the phase difference of the sound wave SWc from an undesirable direction is disarranged with a simple configuration, and there are effects that a target sound, that is, sound of the sound wave SWa, can be accurately detected, and that a sound receiver having high directivity can be implemented.

Figure 9:
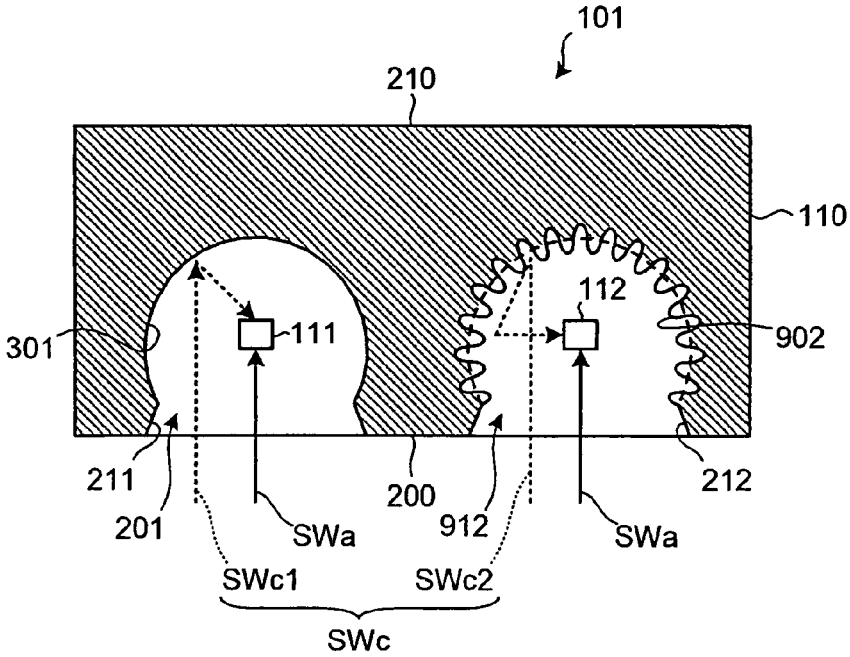
FIG. 9 is a cross-section of the sound receiver according to a fifth example.

The sound receiver according to the fifth example is an example in which the cavities are formed to have surfaces different from each other. FIG. 9 is a cross-section of the sound receiver according to the fifth example. The cross-section shown in FIG. 9 is an example of the cross-section of the sound receiver 101 shown in FIG. 2. Like reference characters are given to like components with the components shown in FIG. 2, and the explanation thereof is omitted.

As shown in FIG. 9, cavities 201 and 912 are formed in the same shape. In the example shown in FIG. 9, the cavities 201 and 912 are formed to have the same substantially circular cross-sections, in other words, in a substantially spherical shape. While the inner peripheral wall 301 to be the surface of the cavity 201 is smooth, an inner peripheral wall 902 to be the surface of the cavity 912 has a randomly uneven surface (protrusions). The vertical intervals of the uneven surface can be arbitrarily set, and can be set to protrusions that are not broken by vibration caused by a sound wave. In an actual situation, the vertical interval is desirable to be 2 millimeters (mm) to 4 mm, more specifically, 3 mm.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 301 of the cavity 201 is reflected by the inner peripheral wall 301 of the cavity 201 to be received by the microphone 111.

Meanwhile, the sound wave SWc2 that reaches the inner peripheral wall 902 of the other cavity 912 is reflected by the inner peripheral wall 902 of the other cavity 912 to be received by the microphone 112. Since the cavities 201 and 912 in the casing 110 are formed to have surfaces that are different from each other, the reflection path length of the sound wave SWc1 and the reflection path length of the sound wave SWc2 are different.

Therefore, a phase difference corresponding to a path length difference between the reflection path length of the sound wave SWc1 and the reflection path length or the sound wave SWc2 is generated in the sound wave SWc. Accordingly, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the fifth example, an effect similar to that of the first example can be achieved. Moreover, there is an effect that the inner peripheral wall 902 that is different from the inner peripheral wall 301 can be formed by making an uneven surface only on the surface of the cavity 912 while both of the cavities 201 and 912 are formed in the same shape and a sound receiver can be easily manufactured. If a randomly uneven surface (protrusions) that is different from that of the inner peripheral wall 902 is formed also on the inner peripheral wall 301 similarly to the inner peripheral wall 902, a similar effect can be achieved.

Furthermore, with such a simple configuration, particularly by varying the surface texture of the cavities, the phase difference of the sound wave SWc from an undesirable direction is disarranged, thereby achieving effects that a target sound, that is, sound of the sound wave SWa, can be accurately detected, and that a sound receiver having high directivity can be implemented.

Figure 10:
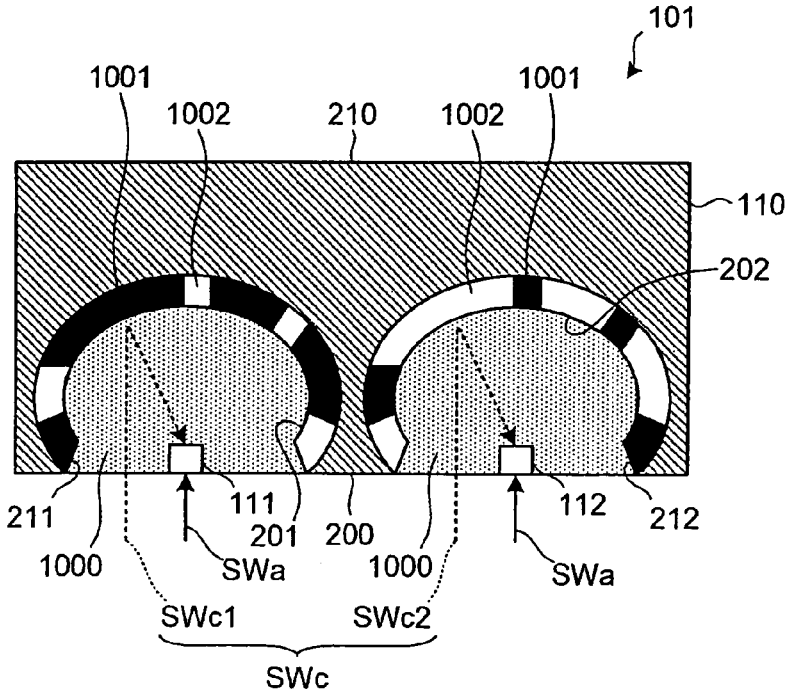
FIG. 10 is a cross-section of the sound receiver according to a sixth example.

The sound receiver according to the sixth example is an example in which each of the cavities is filled with a gel material. FIG. 10 is a cross-section of the sound receiver according to the sixth example. The cross-section shown in FIG. 10 is an example of the cross-section of the sound receiver 101 shown in FIG. 2. Like reference characters are given to like components with the components shown in FIG. 2, and the explanation thereof is omitted.

In the example shown in FIG. 10, each of the cavities 201 and 202 are formed to have the same substantially elliptic cross-section, in other words, in a substantially oval spherical shape. In the cavities 201 and 202, a gel material 1000 is filled. A composition of this gel material 1000 is, for example, gelatin gel, polyvinyl alcohol (PVA) gel, isopropylacrylamide (IPA) gel, or the like.

Moreover, the gel material 1000 slows down a propagation speed of a sound wave to about ¼ of that in air. On the boundaries of the cavities 201 and 202 and the gel material 1000, a hard area 1001 and a soft area 1002 are randomly formed, and these areas 1001 and 1002 form an inner peripheral wall of the cavities 201 and 202. Thus, distribution of a hard portion and a soft portion of the gel material 1000 at the inner peripheral wall becomes different for each of the cavities 201 and 202.

Furthermore, the microphones 111 and 112 are provided at substantially the center of each of the openings 211 and 212. Since the gel material 1000 has the surface on substantially the same plane as the front surface 200 of the casing 110, the microphones 111 and 112 are arranged to be embedded a little in the gel material 1000, and a part thereof is exposed from the gel material 1000. In other words, the microphones 111 and 112 are supported by the gel material 1000 in a fixed manner, and therefore, the supporting member 220 is not required as in the first to the fifth examples described above. Thus, it is possible to simplify the configuration, to reduce the number of parts, and to simplify manufacturing.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the gel material 1000 at the opening 211 propagates in the gel material 1000 at ¼ speed of the speed of sound in air to reach, for example, the hard area 1001. The hard area 1001 fixed-end reflects the sound wave SWc1.

Meanwhile, the sound wave SWc2 that reaches the gel material 1000 at the opening 212 propagates in the gel material 1000 at ¼ speed of the speed of sound in air to reach, for example, the soft area 1002. The soft area 1002 free-end reflects the sound wave SWc2. Thus, the sound wave SWc is reflected randomly by fixed end reflection or free end reflection depending on an area at which the sound wave SWc is reflected, and therefore, the phase difference of the sound wave SWc randomly varies. Accordingly, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the sixth example, an effect similar to that of the first example can be achieved. Moreover, in the sixth example, by filling the cavities 201 and 202 with the gel material 1000, the propagation speed of a sound wave can be slowed down to ¼ speed of that in air. Therefore, effects that the size of the casing 110 can be made smaller to about ¼ of the size thereof when the inside of the cavities 201 and 202 is filled with air, and that random variation of the phase difference of the sound wave SWc to be reflected can be achieved.

Moreover, by filling the cavities 201 and 202 with the gel material 1000, and by forming the inner peripheral walls having random distribution of a hard portion and a soft portion, the phase difference of the reflected sound wave SWc can be randomly varied. Thus, effects that a target sound, that is, sound of the sound wave SWa, can be accurately detected, and that implementation of a sound receiver having high directivity can be achieved. If the composition distribution of the gel material 1000 is different, the sound wave SWc is diffusely reflected and the phase difference randomly varies. Therefore, the composition of the gel itself can be the same in right and left.

While the sound processing device according to the first embodiment includes the sound receiver 101 having multiple (two in the example shown in FIG. 2) cavities, the sound processing device according to the second embodiment includes a sound receiver having a single cavity. Like reference characters are given to like components with components shown in FIG. 1 and FIG. 2, and explanation thereof is omitted.

Figure 11:
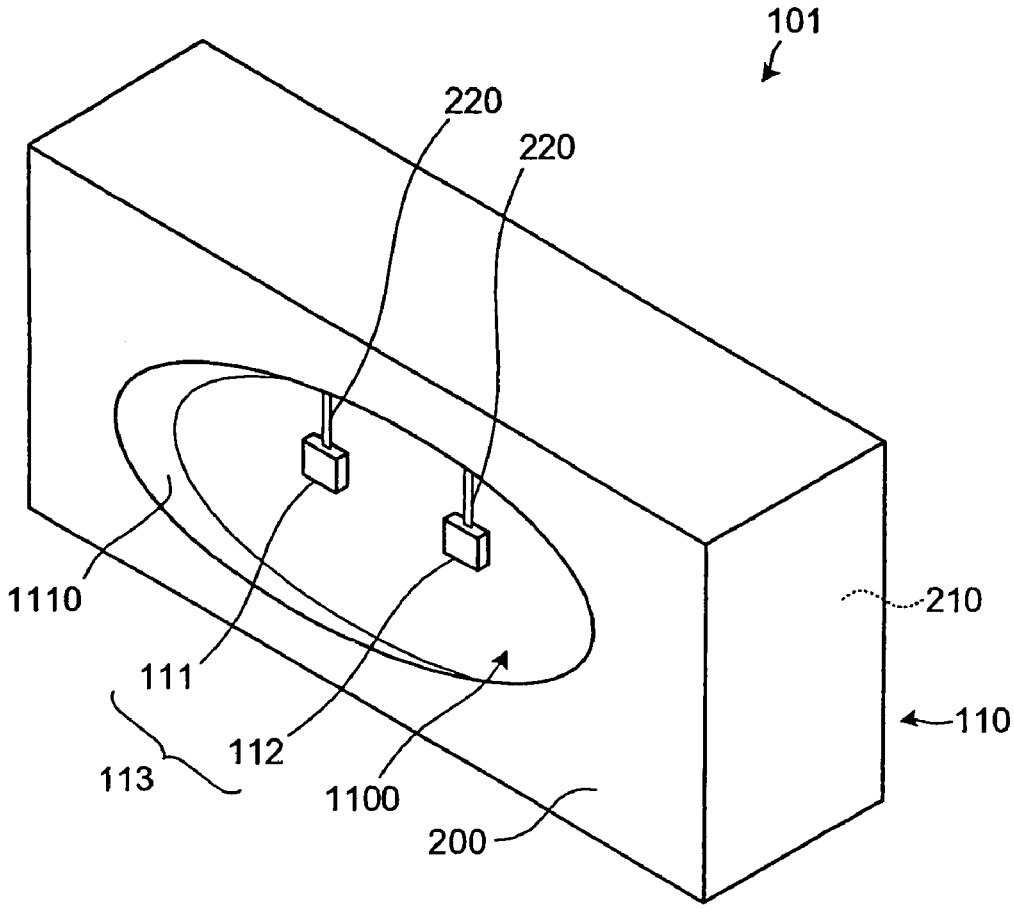
FIG. 11 is a perspective view illustrating the external appearance of a sound receiver according to a second embodiment of the present invention.

First, an external appearance of the sound receiver according to the second embodiment of the present invention is explained. FIG. 11 is a perspective view illustrating the external appearance of the sound receiver according to the second embodiment of the present invention. As shown in FIG. 11, a single cavity 1100 is formed on the front surface 200 of the casing 110.

Moreover, the cavity 1100 has an opening 1110 on the front surface 200 and is otherwise enclosed, i.e., the cavity 1100 does not open through to the rear surface 210. Furthermore, the microphones 111 and 112 are arranged in the cavity 1100 maintaining the predetermined distance d in the longitudinal direction of the casing 110, and are supported by the supporting members 220 in a fixed manner. The positions at which the microphones 111 and 112 are arranged can be any positions, inside the cavity 1100, that can be viewed through the opening 1110.

Figure 12:
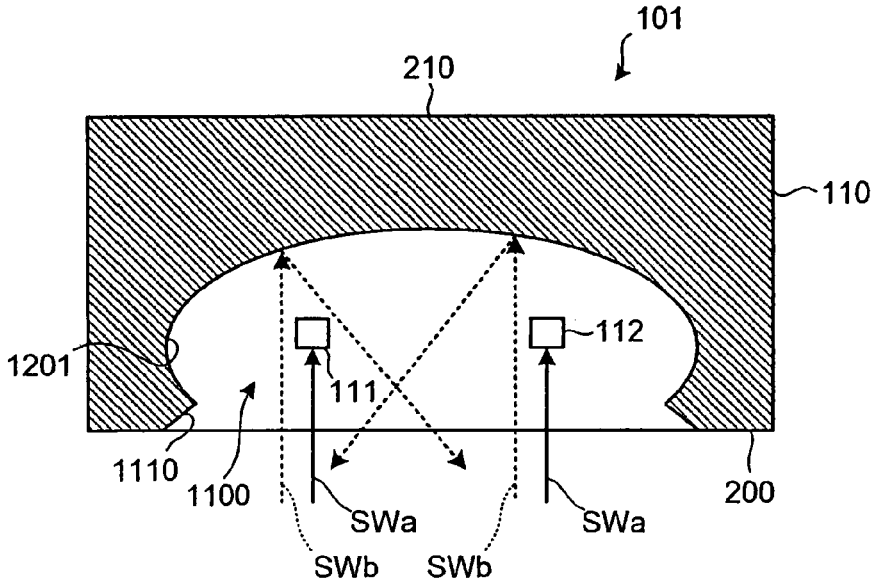
FIG. 12 is a cross-section of the sound receiver according to a seventh example.

FIG. 12 is a cross-section of the sound receiver according to the seventh example. The cross-section shown in FIG. 12 is an example of a cross-section of the sound receiver 101 shown in FIG. 2. Like reference characters are given to like components with the components shown in FIG. 2 and the explanation thereof is omitted.

In the example shown in FIG. 12, the cavity 1100 is formed to have a substantially elliptic shape, in other words, in an oval spherical shape, and a sound wave is input through the opening 1110 formed at the front surface 200 of the casing 110. The shape of the cavity 1100 is not limited to a substantially oval spherical shape, and can be a three-dimensional shape that has random curved sides or a polyhedron. A sound wave from an external source is input only through the opening 1110, and a sound wave from directions other than this direction is shielded by the casing 110 that is formed with a sound absorbing material, and therefore, is not input, thereby enabling to improve the directivity of the microphone array 113.

With such a configuration, the sound wave SWa that directly reaches the microphones 111 and 112 is directly received by the microphones 111 and 112 at the predetermined phase difference. On the other hand, the sound wave SWb that reaches an inner peripheral wall 1201 of the cavity 1100 passes through the inner peripheral wall 1201 to be absorbed by the inner peripheral wall 1201, or is reflected by the inner peripheral wall 1201 to be output through the cavity 1100. Thus, reception of the sound wave SWb can be suppressed.

As described, according to the sound receiver 101 according to the seventh example, only a sound wave coming from a predetermined direction is received and reception of a sound wave coming from directions other than the predetermined direction is prevented, thereby achieving effects that a target sound wave can be accurately detected, and that a sound receiver having high directivity is implemented.

Figure 13:
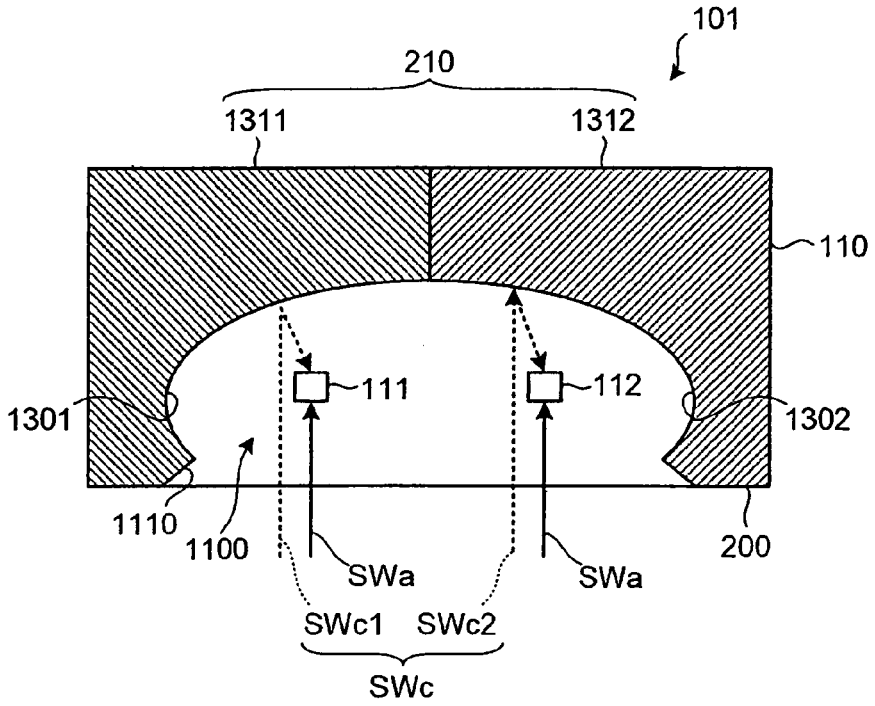
FIG. 13 is a cross-section of the sound receiver according to an eighth example.

The sound receiver according to the eighth example is an example in which the material of the inner peripheral wall of the cavity is varied. FIG. 13 is a cross-section of the sound receiver according to the eighth example. The cross-section shown in FIG. 13 is an example of the cross section of the sound receiver 101 shown in FIG. 2. Like reference characters are given to like components with the components shown in FIG. 2 and FIG. 12, and the explanation thereof is omitted.

In the example shown in FIG. 13, the casing 110 is constituted of a plurality (two in the example shown in FIG. 13) of cells 1311 and 1312 that are formed with sound absorbing materials having different hardness for each of the microphones 111 and 112. The materials of the cells 1311 and 1312 are selected from among acrylic resin, silicon rubber, urethane, and aluminum described above. Specifically, for example, the cell 1311 is formed with acrylic resin, and the other cell 1312 is formed with silicon rubber.

In such a configuration, the sound wave SWa that directly reaches the microphones 111 and 112 is directly received by the microphones 111 and 112 at the predetermined phase difference as shown in FIG. 1. On the other hand, the sound wave SWc (SWc1, SWc2) that reaches inner peripheral walls 1301 and 1302 of the cells 1311 and 1312 are reflected by the inner peripheral walls 1301 and 1302. At this time, the sound wave SWc1 that is reflected by the inner peripheral wall 1301 of the cell 1311 changes in phase corresponding to the material of the cell 1311.

Moreover, the sound wave SWc2 that is reflected by the inner peripheral wall 1302 of the other cell 1312 changes in phase corresponding to the material of the other cell 1312. Since the hardness of the materials of the cell 1311 and the other cell 1312 differ, the phase change of the sound wave SWc1 and SWc2 also differ. Therefore, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the eighth example, an effect similar to that of the first example can be achieved. Moreover, there are effects that a target sound, that is, sound of the sound wave SWa, can be accurately detected by disarranging the phase difference of the sound wave SWc from an undesirable direction with a simple configuration, and that a sound receiver having high directivity can be implemented.

Figure 14:
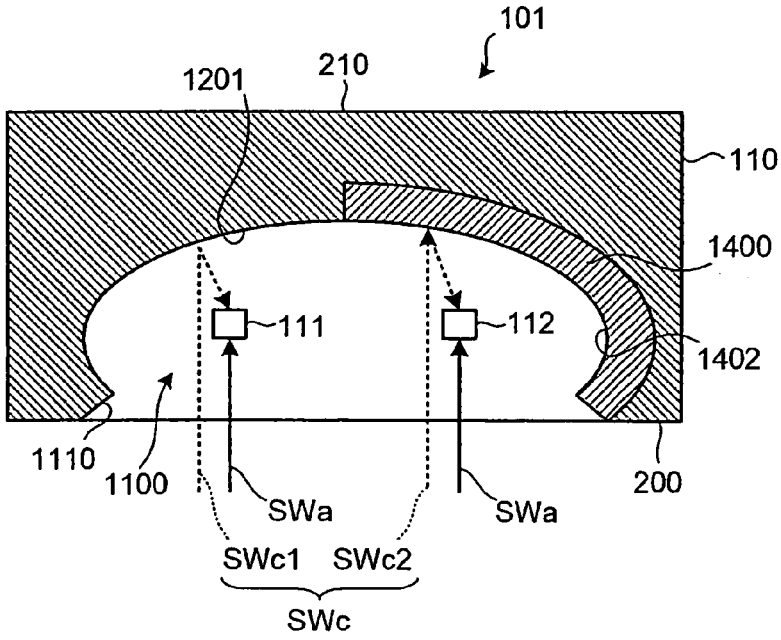
FIG. 14 is a cross-section of the sound receiver according to a ninth example.

The sound receiver according to the ninth example is an example in which materials of a casing and a sound absorbing member that form the inner peripheral wall of a cavity are different. FIG. 14 is a cross-section of the sound receiver according to the ninth example. The cross-section shown in FIG. 14 is an example of the cross-section of the sound receiver 101 shown in FIG. 2. Like reference characters are given to like components with the components shown in FIG. 2, FIG. 12, and FIG. 13 and the explanation thereof is omitted.

In the example shown in FIG. 14, an inner peripheral wall 1402 of the cavity 1100 is formed with a sound absorbing member 1400 having different hardness from the casing 110. Materials of the casing 110 and the sound absorbing member 1400 that forms the inner peripheral wall 1402 are selected from among, for example, acrylic resin, silicon rubber, urethane, and aluminum described above. Specifically, for example, when the casing 110 is formed with acrylic resin, the sound absorbing member 1400 that forms the inner peripheral wall 1402 is formed with a material other than acrylic resin, for example, with silicon rubber.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 1201 of the casing 110 is reflected by the inner peripheral wall 1201. At this time, the sound wave SWc1 that is reflected by the inner peripheral wall 1201 changes in phase corresponding to the material of the casing 110.

Meanwhile, the sound wave SWc2 that is reflected by the inner peripheral wall 1402 changes in phase corresponding to the material of the sound absorbing member 1400 that forms the inner peripheral wall 1402. Since the hardness of the material of the casing 110 that forms the inner peripheral wall 1201 and the material of the sound absorbing member 1400 that forms the inner peripheral wall 1402 are different from each other, the phase change of the sound wave SWc1 and the SWc2 also differ. Therefore, the sound wave SWc is received by the microphones 111 and 112 at a phase difference that is different from the phase difference of the sound wave SWa, and is determined as noise by the sound-source determining circuit 123 shown in FIG. 1.

Figure 15:
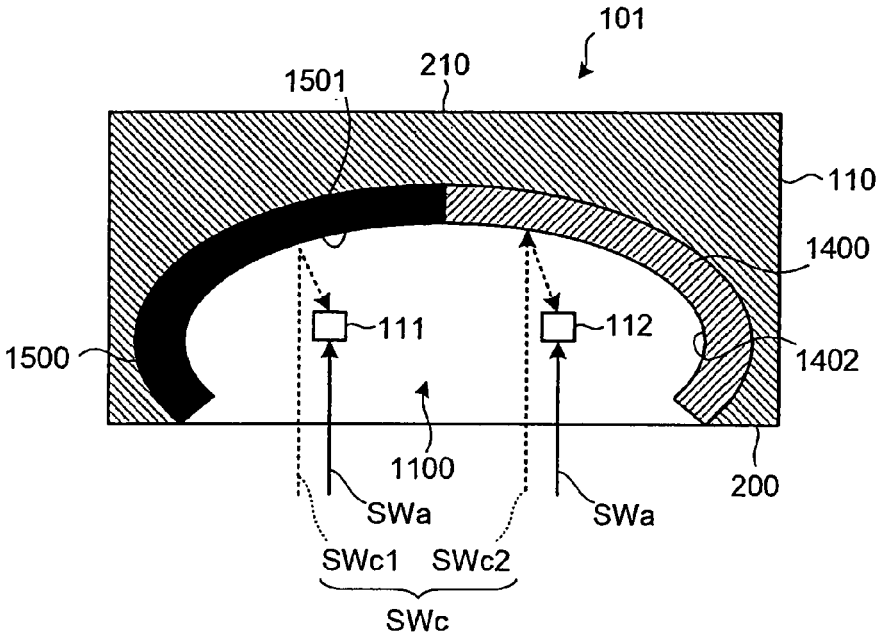
FIG. 15 is a cross-section of another example of the sound receiver according to the ninth example.

FIG. 15 is a cross-section of another example of the sound receiver 101 according to the ninth example. As shown in FIG. 15, inner peripheral walls 1501 and 1402 of the cavity 1100 are formed with sound absorbing members 1500 and 1400 that are different in hardness from each other.

The material of the sound absorbing member 1500 is also selected from among acrylic resin, silicon rubber, urethane, and aluminum described above, similarly to the sound absorbing member 1400. Specifically, for example, when the sound absorbing member 1500 that forms the inner peripheral wall 1501 is formed with acrylic resin, the sound absorbing member 1400 that forms the inner peripheral wall 1402 is formed with a material other than acrylic resin, for example, with silicon rubber.

In this configuration also, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 1501 is reflected by the inner peripheral wall 1501. At this time, the sound wave SWc1 that is reflected by the inner peripheral wall 1501 changes in phase corresponding to the material of the sound absorbing member 1500 that forms the inner peripheral wall 1501.

Meanwhile, the sound wave SWc2 that is reflected by the inner peripheral wall 1402 changes in phase corresponding to the material of the sound absorbing member 1400 that forms the inner peripheral wall 1402. Since the hardness of the material of the sound absorbing member 1500 that forms the inner peripheral wall 1501 and the material of the sound absorbing member 1400 that forms the inner peripheral wall 1402 are different from each other, the phase change of the sound waves SWc1 and SWc2 also differ. Therefore, the sound wave SWc is received by the microphones 111 and 112 at a phase difference that is different from the phase difference of the sound wave SWa, and is determined as noise by the sound-source determining circuit 123 shown in FIG. 1.

Figure 16:
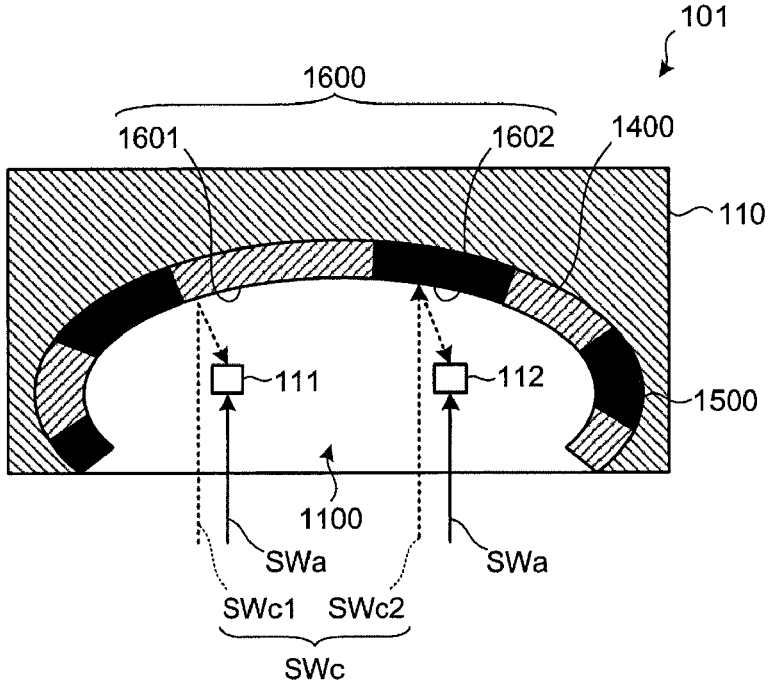
FIG. 16 is a cross-section of another example of the sound receiver according to the ninth example.

FIG. 16 is a cross-section of another example of the sound receiver 101 according to the ninth example. In the example shown in FIG. 16, inner peripheral wall 1600 (1601, 1602) is formed with a plurality (two in the example shown in figure) sound absorbing members 1400 and 1500.

Since the arrangement and the size of areas of the sound absorbing members 1400 and 1500 are randomly set, the arrangement and the size of areas of the inner peripheral walls 1601 and 1602 are also random. Therefore, when the same sound wave reaches the sound receiver 101, the sound wave is reflected by the surface of the sound absorbing members 1400 (1500), which are different from each other. Thus, phases of the sound waves SWc1 and SWc2 that are reflected by the inner peripheral walls 1601 and 1602 can be randomly changed. Therefore, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the ninth example, an effect similar to that of the first example can be achieved. Moreover, there are effects that a target sound, that is, sound of the sound wave SWa, can be accurately detected by disarranging the phase difference of the sound wave SWc from an undesirable direction with a simple configuration, and that a sound receiver having high directivity can be implemented.

Figure 17:
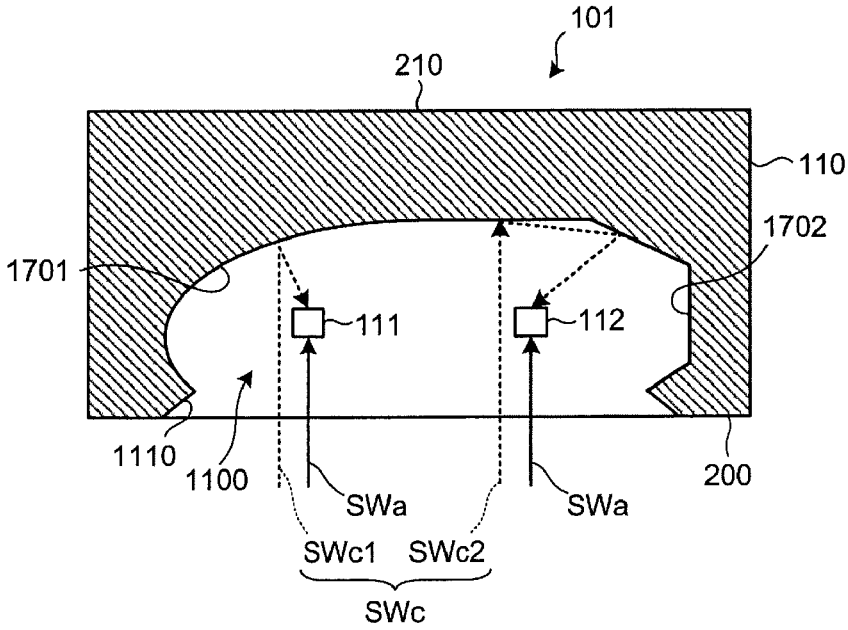
FIG. 17 is a cross-section of the sound receiver according to a tenth example.

The sound receiver according to the tenth example is an example in which the shape of cavity differs respectively according to the microphones. FIG. 17 is a cross-section of the sound receiver according to the tenth example. The cross-section shown in FIG. 17 is an example of the cross-section of the sound receiver 101 shown in FIG. 2. Like reference characters are given to like components with the components shown in FIG. 2, and the explanation thereof is omitted.

In the example shown in FIG. 17, a left half and a right half of the cavity 1100 are formed in different shapes from each other. In the example shown in FIG. 17, the left half of the opening hall 1100 is formed to have a substantially circular cross-section, in other words, in a substantially spherical shape, and the right half of the cavity 1100 is formed to have a substantially polygonal cross-section, in other words, in a substantially polyhedron shape, as one example.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches an inner peripheral wall 1701 of the left half of the cavity 1100 is reflected by the inner peripheral wall 1701 to be received by the microphone 111.

Moreover, the sound wave SWc2 that reaches an inner peripheral wall 1702 of the right half of the cavity 1100 is reflected by the inner peripheral wall 1702 to be received by the microphone 112. Since the left half and the right half of the cavity 1100 are formed in different shapes from each other, the reflection path length of the sound wave SWc1 and the reflection path length of the sound wave SWc2 are different.

Therefore, a phase difference corresponding to a path length difference between the reflection path length of the sound wave SWc1 and the reflection path length SWc2 is generated in the sound wave SWc. Accordingly, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the tenth example, an effect similar to that of the first example can be achieved. Moreover, with a simple configuration, merely by varying the shapes of the cavity, effects that a target sound, that is, sound of the sound wave SWa, can be accurately detected, and that implementation of a sound receiver having high directivity can be achieved.

Figure 18:
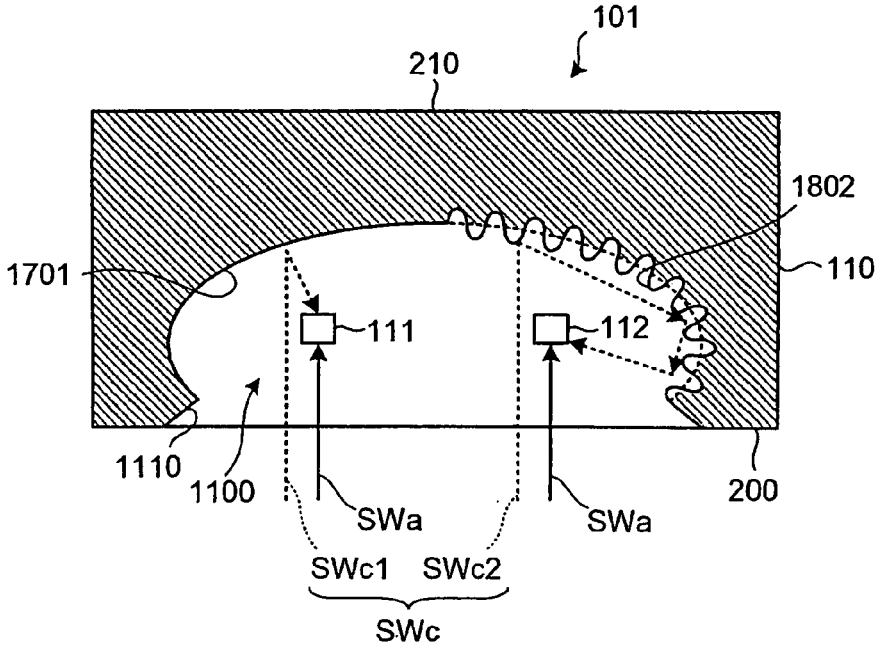
FIG. 18 is a cross-section of the sound receiver according to an eleventh example.

The sound receiver according to the eleventh example is an example in which the surface textures of the cavity differ respectively according to the microphones. FIG. 18 is a cross-section of the sound receiver according to the eleventh example. The cross-section shown in FIG. 18 is an example of the cross-section of the sound receiver shown in FIG. 2. Like reference characters are given to like components with the components shown in FIG. 2, and the explanation thereof is omitted.

In the example shown in FIG. 18, the cavity 1100 is formed to have a substantially circular cross-section, in other words, in a substantially spherical shape. While the inner peripheral wall 1701 to be the surface of the left half of the cavity 1100 is smooth, an inner peripheral wall 1802 to be the surface of the right half of the cavity 1100 has a randomly uneven surface (protrusions). The vertical intervals of the uneven surface can be arbitrarily set, and can be set to protrusions that are not broken by vibration caused by a sound wave. In an actual situation, the vertical interval is desirable to be 2 mm to 4 mm, more specifically, 3 mm.

In such a configuration, the sound wave SWa that directly reaches the microphones 111 and 112 is directly received by the microphones 111 and 112 at the predetermined phase difference as shown in FIG. 1. On the other hand, the sound wave SWc enters the cavity 1100. In the sound wave SWc, the sound wave SWc1 that reaches the inner peripheral wall 1701 is reflected by the inner peripheral wall 1701 to be received by the microphone 111.

Moreover, the sound wave SWc2 that reaches the inner peripheral wall 1802 of the right half of the cavity 1100 is reflected by the inner peripheral wall 1802 to be received by the microphone 112. Since the inner peripheral walls 1701 and 1802 of the cavity 1100 have different surface textures from each other, the reflection path length of the sound wave SWc1 and the reflection path length of the sound wave SWc2 are different from each other.

Therefore, a phase difference corresponding to a path length difference between the reflection path length of the sound wave SWc1 and the reflection path length of the sound wave SWc2 is generated in the sound wave SWc. Accordingly, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the eleventh example, an effect similar to that of the first example can be achieved. Moreover, there is an effect that the inner peripheral wall 1802 that has a different surface texture from that of the inner peripheral wall 1701 of the left half of the cavity 1100 can be formed by making an uneven surface only on the surface of the right half of the cavity 1100, and a sound receiver 101 can be easily manufactured. If a randomly uneven surface (protrusions) that is different from that of the inner peripheral wall 1802 is formed also on the inner peripheral wall 1701, similarly to the inner peripheral wall 1802, a similar effect can be achieved.

Furthermore, with such a simple configuration, particularly by varying the surface texture of the cavity, the phase difference of the sound wave SWc from an undesirable direction is disarranged, thereby achieving effects that a target sound, that is, sound of the sound wave SWa, can be accurately detected, and that a sound receiver having high directivity can be implemented.

Figure 19:
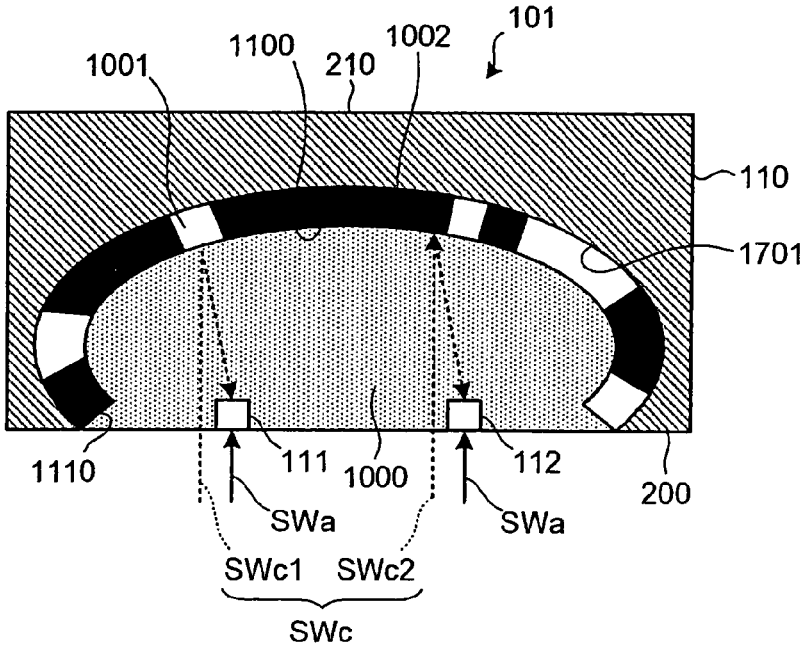
FIG. 19 is a cross-section of the sound receiver according to a twelfth example.

The sound receiver according to the twelfth example is an example in which a gel material is filled in the cavity. FIG. 19 is a cross-section of the sound receiver according to the twelfth example. The cross-section shown in FIG. 19 is an example of the cross-section of the sound receiver 101 shown in FIG. 2. Like reference characters are given to like components with the components shown in FIG. 2, and the explanation thereof is omitted.

In the example shown in FIG. 19, the cavity 1100 is formed to have a substantially elliptic cross-section, in other words, in a substantially oval spherical shape. In the cavity 1100, the gel material 1000 is filled. A composition of this gel material 1000 is for example, gelatin gel, PVA gel, IPA gel, or the like.

Moreover, the gel material 1000 slows down a propagation speed of a sound wave to about ¼ of that in air. On the boundaries of the cavity 1100 and the gel material 1000, the hard area 1001 and the soft area 1002 are randomly formed, and these areas 1001 and 1002 form an inner peripheral wall of the cavity 1100. Thus, distribution of a hard portion and a soft portion of the gel material 1000 at the inner peripheral wall is varied.

Furthermore, the microphones 111 and 112 are provided at substantially the center of the cavity 1100. Since the gel material 1000 has the surface on substantially the same plane as the front surface 200 of the casing 110, the microphones 111 and 112 are arranged to be embedded a little in the gel material 1000, and a part thereof is exposed from the gel material 1000. In other words, the microphones 111 and 112 are supported by the gel material 1000 in a fixed manner, and therefore, the supporting member 220 is not required as in the seventh to the eleventh examples described above. Thus, it is possible to simplify the configuration, to reduce the number of parts, and to simplify manufacturing.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the gel material 1000 at the opening 211 propagates in the gel material 1000 at ¼ speed of the speed of sound in air to reach, for example, the hard area 1001. The hard area 1001 fixed-end reflects the sound wave SWc1.

Meanwhile, the sound wave SWc2 that reaches the gel material 1000 propagates in the gel material 1000 at ¼ speed of the speed of sound in air to reach, for example, the soft area 1002. The soft area 1002 free-end reflects the sound wave SWc2. Thus, the sound wave SWc is reflected randomly by fixed end reflection or free end reflection depending on an area at which the sound wave SWc is reflected. Therefore, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 according to the twelfth example, an effect similar to that of the seventh example can be achieved. Moreover, in the twelfth example, by filling the gel material 1000 in the cavity 1100, the propagation speed of a sound wave can be slowed down to ¼ speed of that in air. Therefore, effects that the size of the casing 110 can be made smaller to about ¼ of the size thereof when the inside of the cavity 1100 is filled with air, and that random variation of the phase difference of the sound wave SWc to be reflected can be achieved.

Figure 20:
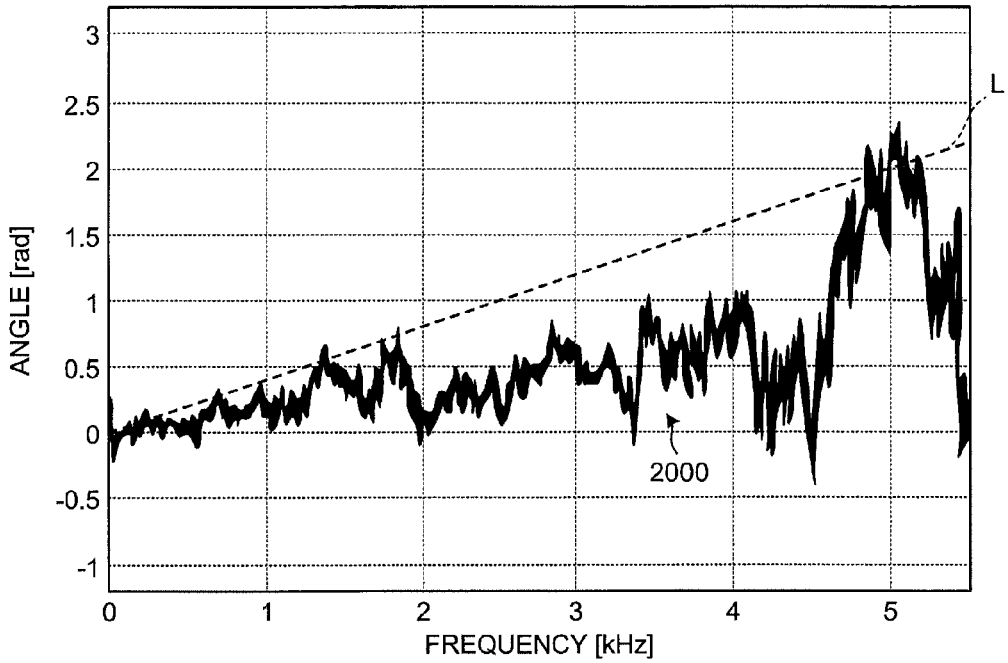
FIG.20 Related Art
FIG. 20 is a graph showing a phase difference spectrum of the conventional sound receiver.
Figure 21:
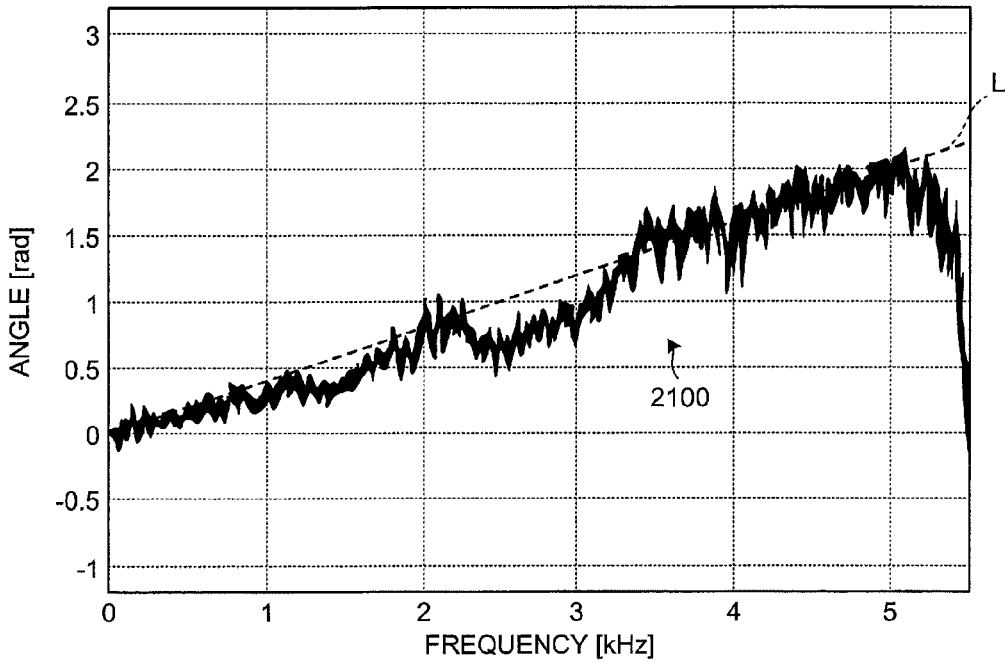
FIG. 21 is a graph showing a phase difference spectrum of the sound receiver according to the first and the second embodiment.

Next, a phase difference spectrum of the conventional sound receiver and a phase difference spectrum of the sound receiver according to the first and the second embodiments of the present invention are explained. FIG. 20 is a graph showing a phase difference spectrum of the conventional sound receiver, and FIG. 21 is a graph showing a phase difference spectrum of the sound receiver according to the first and the second embodiments. In FIG. 20 and FIG. 21, a vertical axis represents a phase difference ($\pm\pi$) and a horizontal axis represents a frequency of a received sound wave (0 kilohertz (kHz) to 5.5 kHz). A dotted line shows a theoretical line.

Comparison of the graphs shown in FIG. 20 and FIG. 21 reveals that while there is a wide gap between a waveform 2000 of the phase difference spectrum shown in FIG. 20 and the theoretical line, there is a little gap between a waveform 2100 of the phase difference spectrum shown in FIG. 21 and the theoretical line. Therefore, in the sound receiver according to the first and the second embodiments, it is possible to accurately receive a sound wave from a target sound source, and to remove sound from a non-target sound source.

Figure 22:
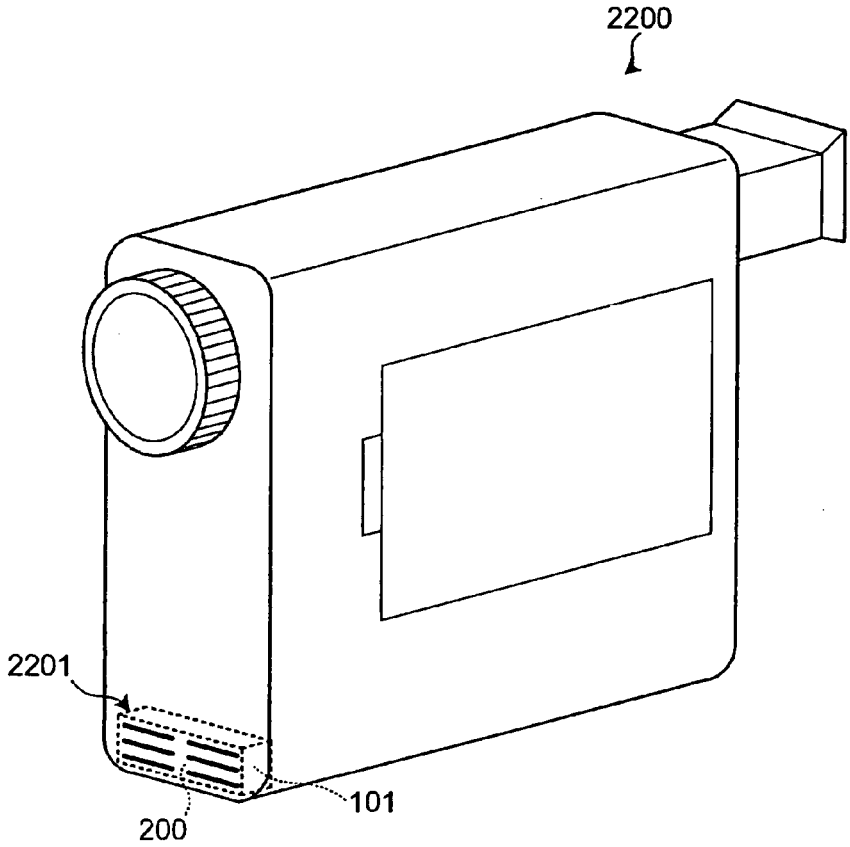
FIG. 22 illustrates an application of the sound receiver according to the first and the second embodiments, to a video camera.
Figure 23:
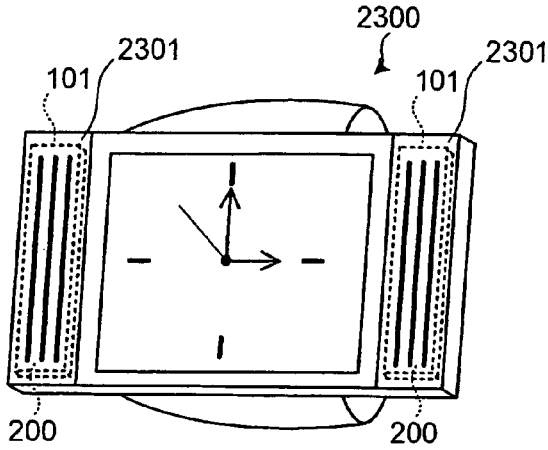
FIG. 23 illustrates an application of the sound receiver according to the first and the second embodiments, to a watch.
Figure 24:
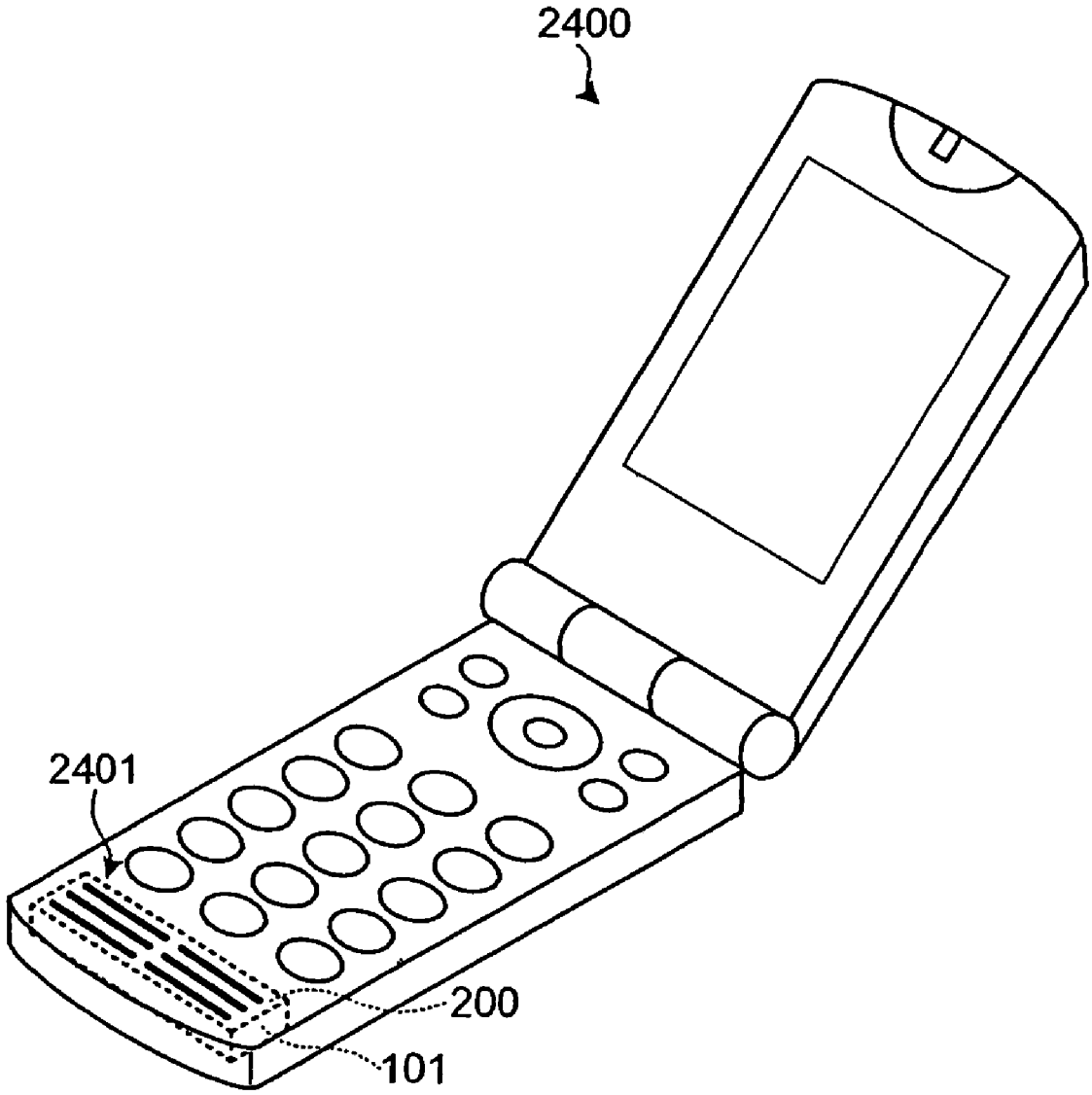
FIG. 24 illustrates an application of the sound receiver according to the first and the second embodiments, to a mobile telephone.

FIG. 22 to FIG. 24 are diagrams for explaining application examples of the sound receiver according to the first and the second embodiments of the present invention. FIG. 22 illustrates an example of application to a video camera. The sound receiver 101 is built in a video camera 2200, and abuts on the front surface 200 and a slit plate 2201. Moreover, FIG. 23 illustrates an example of application to a watch.

The sound receivers 101 are built in a watch 2300 at right and left sides of a dial thereof, and abut on the front surfaces 200 and slit plates 2301, respectively. Furthermore, FIG. 24 illustrates an example of application to a mobile telephone. The sound receiver 101 is built in a mobile telephone 2400 at a mouthpiece, and abuts on the front surface 200 and a slit plate 2401. Thus, it is possible to accurately receive a sound wave from a target sound source.

As described above, according to the embodiments of the present invention, an effect that a sound wave from a target sound source can be accurately detected by such an arrangement that a sound wave coming from only a predetermined direction is received and reception of a sound wave coming from a direction other than the predetermined direction is suppressed, and an effect that a sound receiver having a high directivity in a microphone array can be implemented are achieved. Moreover, by disarranging a phase difference of a sound wave from an undesirable direction with a simple configuration, effects that a sound wave from a target sound source can be accurately detected and that a sound receiver having high directivity can be implemented are achieved.

While in the first and the second embodiments, the microphones 111 and 112 are arranged in a line, the microphones 111 and 112 can be two-dimensionally arranged according to an environment or a device to which the sound receiver 101 is applied. Furthermore, the microphones 111 and 112 used in the first and the second embodiments are preferred to be non-directional microphones. This enables to provide a low-cost sound receiver.

With a sound receiver according to the present invention, an effect that the directivity is improved with a simple configuration is achieved.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sound receiver comprising:
a plurality of microphones; and
a casing that has a plurality of cavities in which the microphones are housed, respectively, each cavity absorbing or reflecting a sound wave,
wherein a size of the microphones is smaller than an opening of the cavities and the sound wave enters through the respective opening, and
wherein the casing has a hardness that differs respectively to each cavity.

2. A sound receiver comprising:
a plurality of microphones; and
a casing that has a plurality of cavities in which the microphones are housed, respectively, each cavity absorbing or reflecting a sound wave,
wherein a size of the microphones is smaller than an opening of the cavities and the sound wave enters through the respective opening, and
wherein inner peripheral walls of the cavities respectively have a different hardness, a different shape, or a surface texture that differs.

3. A sound receiver comprising:
a plurality of microphones; and
a casing that has a plurality of cavities in which the microphones are housed, respectively, each cavity absorbing or reflecting a sound wave,
wherein a size of the microphones is smaller than an opening of the cavities and the sound wave enters through the respective opening,
wherein the cavities are filled with a material that lowers a propagation speed of the sound wave relative to that in air, and
wherein, at a boundary of the material and each of the cavities respectively, distribution of a hard portion and a soft portion of the material differs for each of the cavities.

4. A sound receiver comprising:
a plurality of microphones; and
a casing that has a cavity in which the microphones are housed, the cavity absorbing or reflecting a sound wave,
wherein a size of the microphones is smaller than an opening of the cavity and the sound wave enters through the opening.

5. The sound receiver according to claim 4, wherein each area among a plurality of areas in the cavity respectively corresponds to a microphone among the microphones and has a different hardness.

6. The sound receiver according to claim 4, wherein each area among a plurality of areas in the cavity respectively corresponds to a microphone among the microphones, and an inner peripheral wall of each of the areas has a different hardness.

7. The sound receiver according to claim 4, wherein each area among a plurality of areas in the cavity respectively corresponds to a microphone among the microphones and has a shape that differs.

8. The sound receiver according to claim 4, wherein each area among a plurality of areas in the cavity respectively corresponds to a microphone among the microphones, and an inner wall of each of the areas has a different surface texture.

9. The sound receiver according to claim 4, wherein the cavity is filled with a material that slows a propagation speed of the sound wave relative to that in air.

10. The sound receiver according to claim 9, wherein, at a boundary of the material and the cavity, distribution of a hard portion and a soft portion of the material differs respectively for each area among a plurality of areas in the cavity respectively corresponding a microphone among the microphones.

11. The sound receiver according to claim 4, wherein the microphones are non-directional microphones.

12. A sound receiver comprising:

a plurality of microphones; and a casing that has a plurality of cavities in which the microphones are housed, respectively, wherein inner peripheral walls of the cavities respectively have a different shape, and wherein each of the cavities absorbs or reflects a sound wave, the sound wave entering through the opening of each of the cavities.

13. The sound receiver according to claim 12, wherein each of the plurality of microphones is a non-directional microphone.

* * * * *

UNITED STATES PATENT AND TRADEMARK OFFICE

CERTIFICATE OF CORRECTION

PATENT NO. : 8,315,418 B2
APPLICATION NO. : 11/826350
DATED : November 20, 2012
INVENTOR(S) : Junichi Watanabe It is certified that error appears in the above-identified patent and that said Letters Patent is hereby corrected as shown below:

Title Page, Col. 1, Insert Item (63)

-- Related U.S. Application Data

(63) Continuation of application No. PCT/JP2005/000316, filed on Jan. 13, 2005 --.

Signed and Sealed this
Twenty-ninth Day of October, 2013

Teresa Stanek Rea

Teresa Stanek Rea
*Deputy Director of the United States Patent and Trademark Office*